US006405713B1

(12) United States Patent
Scollard et al.

(10) Patent No.: US 6,405,713 B1
(45) Date of Patent: Jun. 18, 2002

(54) STAMPED FUEL RAIL WITH INTEGRATED MOUNTING BRACKETS

(75) Inventors: Joseph Edward Scollard, Suffolk; James Russell Morris, Newport News; Jeffery Ersin Brittle, Williamsburg; Dean Leigh Spiers, Yorktown, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/946,458

(22) Filed: Sep. 6, 2001

Related U.S. Application Data

(62) Division of application No. 09/606,538, filed on Jun. 30, 2000.

(60) Provisional application No. 60/165,390, filed on Nov. 12, 1999.

(51) Int. Cl.[7] ..... F02H 55/04

(52) U.S. Cl. ..... 123/468; 123/470; 29/888.01

(58) Field of Search ..... 123/468, 469, 123/470, 195 A, 456; 29/888.01

(56) References Cited

U.S. PATENT DOCUMENTS

| | | | | | |
|---|---|---|---|---|---|
| 3,857,573 | A | * | 12/1974 | Pugh | 277/598 |
| 4,457,280 | A | | 7/1984 | Hudson, Jr. | 123/470 |
| 4,519,368 | A | | 5/1985 | Hudson, Jr. | 123/468 |
| 4,751,904 | A | * | 6/1988 | Hudson, Jr. | 123/470 |
| 4,798,187 | A | | 1/1989 | Hudson, Jr. | 123/469 |
| 4,991,556 | A | * | 2/1991 | Mahnke et al. | 123/463 |
| 5,002,030 | A | * | 3/1991 | Mahnke | 123/469 |
| 5,094,211 | A | * | 3/1992 | Mahnke et al. | 123/463 |
| 5,197,436 | A | * | 3/1993 | Ozawa | 123/456 |
| 5,682,857 | A | * | 11/1997 | Briggs et al. | 123/456 |

* cited by examiner

*Primary Examiner*—Tony M. Argonbright
*Assistant Examiner*—Hai H. Huynh

(57) ABSTRACT

An integrated fuel rail portion and mounting bracket assembly is provided. The assembly includes an elongated support portion and at least one mounting bracket integrally connected to the elongated support portion. A method of forming the assembly is also provided.

5 Claims, 1 Drawing Sheet

STAMPED FUEL RAIL WITH INTEGRATED MOUNTING BRACKETS

CROSS-REFERENCE TO RELATED APPLICATION

This application is a divisional application filed pursuant to 35 U.S.C. §§120 and 121 and claims the benefits of prior application Ser. No. 09/606, 538 filed Jun. 30, 2000, which is hereby incorporated by reference in its entirety.

The present application claims priority from U.S. Provisional Application No. 60/165,390, filed Nov. 12, 1999.

FIELD OF THE INVENTION

The present invention relates to fuel rails for internal combustion engines.

BACKGROUND OF THE INVENTION

Previously, mounting brackets for fuel rails used in internal combustion engines were manufactured separately from the fuel rail and then connected to the fuel rail such as by mechanical connection or welding. Such connections required additional manufacturing steps which increased the cost of fabricating the bracket and rail assemblies.

It would be beneficial to develop a mounting bracket and fuel rail assembly in which the mounting bracket was an integral part of the fuel rail.

BRIEF SUMMARY OF THE INVENTION

Briefly, the present invention is an integrated fuel rail portion and mounting bracket assembly. The assembly includes an elongated support portion and at least one mounting bracket integrally connected to the elongated support portion.

Further, the present invention is a method of manufacturing an integrated fuel rail and mounting bracket. The method comprises providing a sheet of metal; stamping the sheet, forming an elongated support portion and at least one mounting bracket; and bending the at least one mounting bracket relative to the fuel rail portion.

BRIEF DESCRIPTION OF THE DRAWING

The accompanying drawing, which is incorporated herein, and constitutes part of this specification, illustrates the presently preferred embodiment of the invention, and, together with the general description given above and the detailed description given below, serves to explain the features of the invention. In the drawing.

DETAILED DESCRIPTION OF THE PREFERRED EMBODIMENT

Figure 1:
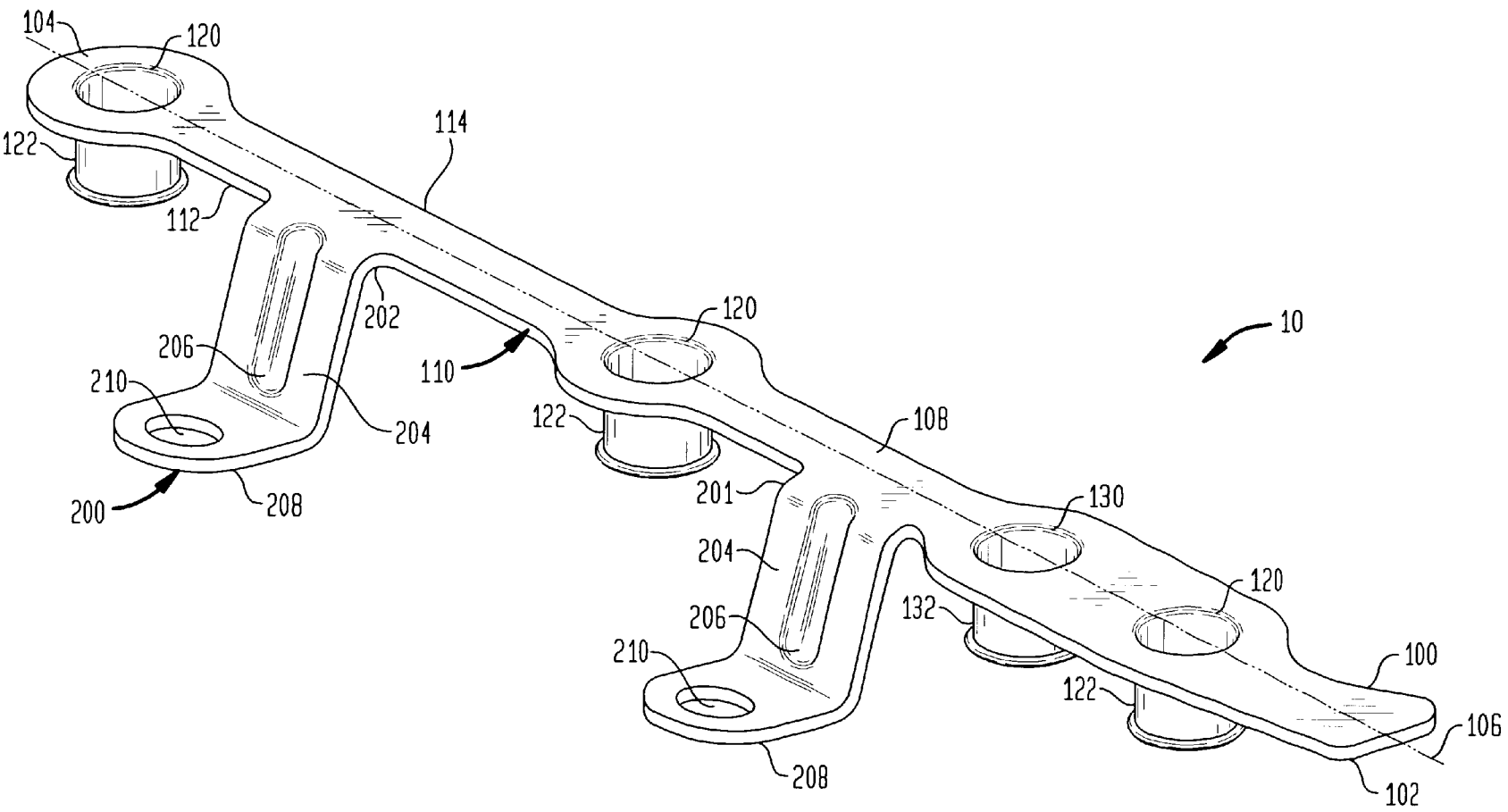
FIG. 1 is a perspective view of a support portion of a fuel rail and integrated mounting brackets according to a preferred embodiment of the present invention.

An integrated fuel rail and mounting bracket assembly 10 (hereinafter "assembly 10") according to a preferred embodiment of the present invention is shown in FIG. 1. The assembly 10 in mounted on an internal combustion engine (not shown) and is used to supply fuel to the engine. The assembly 10 includes a generally elongated support portion 100 and at least one, preferably two, mounting brackets 200. The support portion 100 includes a first end 102, a second end 104, and a longitudinal axis 106 extending therethrough. The support portion 100 also includes a top face 108, an opposing bottom face 110, a first longitudinal side 112 and a second longitudinal side 114.

A top rail portion (not shown) is connected to the top face 108 to form a fuel rail assembly through which fuel flows. A fuel rail assembly into which the present invention can be incorporated is disclosed in U.S. patent application Ser. No. 09/606,539, filed on even date, which is incorporated herein by reference.

A plurality of openings 120 are spaced at predetermined locations along the longitudinal axis 106. The openings 120 extend between the top face 18 and the bottom face 110. One opening 120 is generally located at each of the first and second ends 102, 104, and the remaining openings 120 are generally equally spaced between those openings 120. In FIG. 1, only three openings 120 are shown, although those skilled in the art will recognize that more or less than three openings 120 can be used. The openings 120 open into injector cups 122, which extend downward from the bottom face 110. Injectors (not shown) are inserted into the injector cups 122 to accept fuel which flows through the injector cups 122 from the fuel rail assembly for injection into the engine.

An opening 130 is also located in the support portion 100 along the longitudinal axis 106. The opening 130 opens into a microdamper cup 132 which is used to accommodate a damper (not shown). The damper dampens fuel pressure pulses through the fuel rail. In the design shown, the opening 130 is located between one of the injector cups 122 and one of the mounting brackets 200. However, those skilled in the art will recognize that the opening 130 can be located anywhere along the support 100. Additionally, although only one opening 130 and cup 132 are shown, those skilled in the art will recognize that additional openings 130 and cups 132 can be incorporated into each support portion 100.

Each mounting bracket 200 extends generally from the first side 112 of the support portion 100 and generally transversely from the longitudinal axis 106. As seen in FIG. 1, each mounting bracket 200 is located between adjacent openings 120, although those skilled in the art will recognize that the mounting brackets can be located elsewhere along the support 100. Additionally, while two mounting brackets 200 are preferred, those skilled in the art will recognize that more or less than two mounting brackets 200 can be used.

Each mounting bracket 200 includes a rail portion 202 which is generally co-planar with the support portion 100. A spacer portion 204 is connected to the rail portion 202 and is generally angled with respect to the plane of the support portion 100. As shown in FIG. 1, the spacer portion 204 is generally perpendicular to a plane of the support portion 100, although those skilled in the art will recognize that the spacer portion 204 can be at other angles to the support portion 100 as well. To increase the structural strength of the spacer portion 204, a generally semi-cylindrical stiffener 206 is stamped into the spacer portion 204.

A connector portion 206 is connected to the spacer portion 204 and extends generally parallel to the plane of the support portion 100, although those skilled in the art will recognize that the connector portion 206 can be at other angles with respect to the support portion 100. The connector portion 208 includes at least one opening 210 which is used as a bolt hole to connect the connector portion 208, and thus the entire assembly 10, to a piece of machinery, such as the engine. Although a mechanical connection is preferred, those skilled in the art will recognize that other connections, such as welding, can be used, and the opening 210 can be omitted.

Manufacture of the assembly 10 will now be described. Initially, a generally flat sheet of metal, such as low carbon steel, is provided. The sheet is inserted into a stamping machine (not shown), which stamps the support portion 100 and the mounting brackets 200 from the sheet. In the same stamping process, the stamping machine bends the mounting brackets 200, forming the rail portion 202, the spacer portion 204, and the connector portion 208. Also, during the stamping process, the stamping machine forms the stiffeners 206 and punches the openings 210.

After the support portion 100 and the mounting brackets 200 are stamped, the assembly 10 is moved to a drawing machine (not shown) which deep draws the injector cups 122 and the damper cup 132.

It will be appreciated by those skilled in the art that changes could be made to the embodiment described thereof without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. A method of manufacturing an integrated fuel rail and mounting bracket comprising:

providing a sheet of metal;

stamping the sheet, forming an elongated support portion and at least one mounting bracket; and bending the at least one mounting bracket relative to the fuel rail portion.

2. The method according to claim 1, further comprising, after stamping the sheet, deep drawing a plurality of fuel cups in the support portion.

3. The method according to claim 1, further comprising, after stamping the sheet, deep drawing a damper cup in the support portion.

4. The method according to claim 1, wherein stamping the sheet further comprises forming a stiffener in each of the at least one mounting bracket.

5. The method according to claim 1, wherein stamping the sheet further comprises forming an opening in each of the at least one mounting bracket.

* * * * *